United States Patent [19]

Yahagi et al.

[11] Patent Number: 4,503,446

[45] Date of Patent: Mar. 5, 1985

[54] HEAT-SENSITIVE COLOR-DEVELOPING COMPOSITION

[75] Inventors: Masakichi Yahagi, Tokyo; Kimiaki Kinoshita, Kitamoto; Masashi Enokiya, Tokyo, all of Japan

[73] Assignee: Shin Nisso Kako Co., Ltd., Japan

[21] Appl. No.: 446,520

[22] Filed: Dec. 3, 1982

[30] Foreign Application Priority Data

Dec. 9, 1981 [JP] Japan ..... 56-196967

[51] Int. Cl.[3] ..... B41M 5/18

[52] U.S. Cl. ..... 346/209; 346/216; 346/221; 427/150; 427/151

[58] Field of Search ..... 282/27.5; 428/411, 488, 428/537, 913, 914, 411.1, 488.1, 537.5; 346/209, 216, 217, 221; 427/150, 151

[56] References Cited

FOREIGN PATENT DOCUMENTS

| | | | |
|---|---|---|---|
| 5636 | 6/1978 | Japan | 346/208 |
| 41994 | 3/1982 | Japan | 346/209 |
| 116690 | 7/1982 | Japan | 346/209 |

*Primary Examiner*—Bruce H. Hess

*Attorney, Agent, or Firm*—Abelman Frayne Rezac & Schwab

[57] ABSTRACT

Dibenzyl terephthalate and isophthalate are known compounds. The present invention is concerned with the new use of such known compounds. In a color-developing system which comprises the combination of a color-developing dye and an organic acidic substance, a higher fatty acid amide has been used as a sensitizer for such system. Unexpectedly, we have found that dibenzyl terephthalate or isophthalate is specifically useful as a sensitizer in said system.

16 Claims, No Drawings

HEAT-SENSITIVE COLOR-DEVELOPING COMPOSITION

The present invention relates to a composition which can develop color when exposed to heat.

For heat-sensitive recording method where a color-developing dye being normally colorless or pale in color (electron donor) is brought into color formation with an organic acidic substance (electron acceptor) on heating, there is a keen demand to obtain an increased rate of color formation in response to the speed-up of facsimile or the like communication apparatuses.

In heat-sensitive recording, a higher fatty acid amide has been widely used as a sensitizer for the abovementioned color-developing system, but it cannot meet the current demand sufficiently. We have found that dibenzyl terephthalate and dibenzyl isophthalate when used in the color-developing system can exhibit more excellent sensitizing effect than the higher fatty acid amide does, thereby to constitute the present invention. Thus, the present invention is a heat-sensitive, color-developable composition which comprises a color-developing dye being normally colorless or pale in color, an organic acidic substance capable of causing the color-developing dye to form a color on heating, and dibenzyl telephthalate or/and dibenzyl isoterephthalate.

The technical superiority of the bibenzyl terephthalate or isophthalate as the sensitizer in the color-developing system to the higher fatty acid amide widely used heretofore is demonstrated by the following.

Table 1 shows the comparison of color densities at various temperatures of individual heat-sensitive recording papers which were prepared by using 3-N-methyl-cyclohexylamino-6-methyl-7-anilinofluoran as a color-developing dye, bis(p-hydroxyphenyl)-dimethylmethane (which may be commonly called as "bisphenol A", hereinafter abbreviated as "BPA") as an organic acidic substance and dibenzyl terephthalate, dibenzyl isophthalate or a higher fatty acid amide as a sensitizer. Table 2 and Table 3 respectively show the comparison of color densities of other heat-sensitive recording papers in which 3-diethylamino-6-methyl-7-anilinofluoran (Table 2) or 3-pyrrolidino-6-methyl-7-anilinofluoran (Table 3) is used as a color-developing dye.

TABLE 1

| | Color development temp. (°C.) | | | | |
|---|---|---|---|---|---|
| Sensitizer | 80 | 90 | 100 | 120 | 150 |
| Dibenzyl terephthalate | 35.3 | 27.8 | 25.7 | 24.7 | 24.1 |
| Dibenzyl isophthalate | 33.3 | 26.9 | 24.4 | 24.1 | 23.0 |
| Higher fatty acid amide | 39.8 | 31.1 | 26.5 | 25.3 | 24.6 |

TABLE 2

| | Color development temp. (°C.) | | | | |
|---|---|---|---|---|---|
| Sensitizer | 80 | 90 | 100 | 120 | 150 |
| Dibenzyl terephthalate | 30.9 | 26.2 | 25.2 | 24.7 | 23.6 |
| Dibenzyl isophthalate | 29.9 | 26.0 | 25.2 | 24.9 | 23.7 |
| Higher fatty acid amide | 36.5 | 28.2 | 25.5 | 25.2 | 23.8 |

TABLE 3

| | Color development temp. (°C.) | | | | |
|---|---|---|---|---|---|
| Sensitizer | 80 | 90 | 100 | 120 | 150 |
| Dibenzyl terephthalate | 27.7 | 25.5 | 24.1 | 24.0 | 23.4 |
| Dibenzyl isophthalate | 27.0 | 25.7 | 24.8 | 24.5 | 23.7 |

TABLE 3-continued

| | Color development temp. (°C.) | | | | |
|---|---|---|---|---|---|
| Sensitizer | 80 | 90 | 100 | 120 | 150 |
| Higher fatty acid amide | 34.0 | 27.6 | 25.3 | 24.4 | 23.6 |

The heat-sensitive recording papers used for the above tests were those prepared and used in Examples 1, 2 and 3. The figures which refer to the color density in each table are based on the L value which is the measure of brightness among the L, a and b values obtainable when the colored surface was measured by means of a color difference computor (Nippon Denshoku Kogyo K.K.). In case of the fluoran compounds used in the examples, the developed color is almost black with the a and b values being negligible small, and therefore, the L value can afford good coincidence with the degree of blackness by visual inspection.

Dibenzyl terephthalate used herein is a compound disclosed in Japanese Patent Publication No. 3771/1971 and dibenzyl isophthalate is the one disclosed in British Patent Specification No. 1,094,195. Their respective melting points are 95.0°-96.0° C. (lit. value 94° C.) and 83.0°-84.5° C. (lit. value 82°-83° C.). These esters can be used singly or in combination, or together with other sensitizers. The amount of such esters used in the present invention is 10-400% by weight and preferably 50-200% by weight, based on the weight of a color-developing dye used in the color-developing system. For the practical use, they are pulverized alone and then combined with the separately pulverized color-developing dye and organic acidic substance, or alternatively, they can be copulverized with the color-developing dye, etc.

The composition according to the present invention is dispersed in a solution of a water-soluble binder in water to form a suspension, which is then coated onto any appropriate substrate and dried to obtain a heat-sensitive recording material.

Color-developing dyes being normally colorless or pale in color include, for example, Leuko dyes of fluoran type, phthalide type, lactam type, triphenylmethane type, spiropyrane type, etc., without limiting thereto. These may be used in combination if desired. Use of a black color-developing dye of the fluoran type is particularly preferred.

The organic acidic substances typically usable for the present invention are BPA and benzyl p-hydroxybenzoate, but they are not limited thereto.

Usable as water-soluble binders for use in connection with the invention are, for example, polyvinyl alcohol, hydroxyethyl cellulose, carboxymethyl cellulose, styrene-maleic anhydride copolymer salts, styrene-butadiene copolymer emulsions, vinyl acetate-maleic anhydride copolymer emulsions, polyacrylic acid salts, polyacrylamides, starches, caseins, arabic gum, etc., without limiting thereto.

The above-referred suspensions may optionally include dispersing agents (e.g. sodium dioctyl succinate, sodium dodecyl benzene sulfonate, sodium lauryl sulfate, fatty acid metal salts, etc.), sensitizers (e.g. stearyl amide and the like higher fatty acid amide), anti-sticking agents (e.g. stearic acid, zinc stearate, calcium stearate, carnaube wax, paraffin wax, ester wax), filling agents (e.g. clay, talc, kaolin, satin white, titanium dioxide, calcium carbonate, magnesium carbonate, barium sulfate, magnesium silicate, aluminum silicate, etc.), defoaming agents, ultraviolet-absorbing agents, optical whitening agents and the like.

The above suspensions can be used not only for the preparation of heat-sensitive recording materials, but also for the preparation of electroheat-sensitive recording materials by coating on an electroconductive layer carried on a substrate, followed by drying, as seen in Japanese Patent Publication Nos. 16154/1976 and 16155/1976.

EXAMPLE 1

7.0 g of dibenzyl terephthalate, 41.5 g of a 15% aqueous solution of polyvinyl alcohol ("Kuraray Poval PVA-105", manufactured and sold by Kuraray Co., Ltd., Japan), 11.5 g of clay ("UW-90", manufactured and sold by Engelhard Inc., U.S.A.) and 400 g of pure water were charged together with 100 g of glass beads (1–1.5 mm in diameter) into a 250 ml-capacity polyethylene bottle, which after sealing was placed on a paint conditioner of Reol Devil Ltd. After shaking the bottle at 630 r.p.m. for 8 hours, the glass beads were removed with leaving an aqueous suspension of dibenzyl terephthalate ("Liquid A-1").

Similarly, dibenzyl isophthalate was used to obtain its suspension ("Liquid A-2") and certain higher fatty acid amide ("Amide AP-1", manufactured and sold by Nippon Chem. Industry Co., Ltd.) was used to obtain its suspension ("Liquid A-3").

Separately, 10.5 g of BPA, 41.5 g of a 15% aqueous solution of PVA (same as above), 8.5 g of the clay (same as above) and 40.4 g of pure water were charged together with 100 g of glass beads into a 250 ml-capacity polyethylene bottle, which after sealing was placed on a paint conditioner. After shaking the bottle at 630 r.p.m. for 8 hours, the glass beads were removed to leave an aqueous suspension of BPA ("Liquid B").

In addition, 7.0 g of 3-N-methylcyclohexylamino-6-methyl-7-anilinofluoran, 41.5 g of a 15% aqueous solution of PVA (same as above), 11.5 g of the clay (same as above) and 40.0 g of pure water were charged together with 100 g of glass beads into a polyethylene bottle, which after sealing was placed on a paint conditioner. After shaking the bottle at 630 r.p.m. for 5 hours, the glass beads were removed to leave an aqueous suspension of the fluoran compound ("Liquid C"). The environmental temperature during the shaking was about 35° C.

10.0 g of the liquid B and 5.0 g of the liquid C were uniformly mixed with 5.0 g of each one of the liquid A-1, liquid A-2 and liquid A-3, thereby to yield three coating liquids. These coating liquids were individually coated manually on white paper substrates by means of a wire rod No. 12 and then dried at a temperature of 60° C. for 3 minutes thereby to obtain heat-sensitive recording papers I, II and III. Both sides of these papers were heated for 5 seconds at a temperature of 80° C., 90° C., 100° C., 120° C. or 150° C. by using a dry heating tester (manufactured and sold by Kishino Science Machinery Co., Ltd.). According to the observation of the sides on which the color developed, the heat-sensitive recording papers I and II when heated at 80° C. and 90° C. were much more blackish than the heat-sensitive recording paper III. The brightness values L as measured by a color difference computor ("DICOM ND-504 DE", manufactured and sold by Nippon Denshoku Kogyo K.K.) were set forth in Table 1. The smaller L value means that the developed color is more blackish.

EXAMPLE 2

The same procedures as in Example 1 were repeated but using 3-diethylamino-6-methyl-7-anilinofluoran in place of the 3-N-methylcyclohexylamino-6-methyl-7-anilinofluoran used in the preparation of the liquid C in Example 1. In the instant case, the black color of the recording papers using dibenzyl terephthalate or isophthalate and subject to heating at 80° C. or 90° C. were found much more dense than that of the recording papers using the higher fatty acid amide. The L values on the colored surfaces of these recording papers are set forth in Table 2.

EXAMPLE 3

The same procedures as in Example 1 were repeated but using 3-pyrrolidino-6-methyl-7-anilinofluoran in place of the 3-N-methylcyclohexylamino-6-methyl-7-anilinofluoran used in the preparation of the liquid C in Example 1. In the instant case, the black color of the recording papers using dibenzyl terephthalate or isophthalate and subject to heating at 80° C. or 90° C. were found much more dense than that of the recording papers using the higher fatty acid amide. The L values on the colored surfaces of these recording papers are set forth in Table 3.

EXAMPLE 4

The same procedures as in Example 1 were repeated but using benzyl p-hydroxybenzoate (one of the p-hydroxybenzoic acid esters disclosed in Japanese Pre-Exam. Publication No. 144,193/1981) as an organic acidic substance, 3-N-methyl-cyclohexylamino-6-methyl-7-anilinofluoran as a color-developing dye and dibenzyl terephthalate or higher fatty acid amide as a sensitizer. The L values obtained on the colored surfaces are set forth in Table 4. In the same test but using 3-diethylamino-6-methyl-7-anilinofluoran as a color-developing dye, the L values are set forth in Table 5.

TABLE 4

| | Color development temp. (°C.) | | | | |
|---|---|---|---|---|---|
| Sensitizer | 80 | 90 | 100 | 120 | 50 |
| Dibenzyl terephthalate | 25.2 | 24.2 | 23.3 | 22.3 | 22.1 |
| Higher fatty acid amide | 27.4 | 25.4 | 24.2 | 23.8 | 23.6 |

TABLE 5

| | Color development temp. (°C.) | | | | |
|---|---|---|---|---|---|
| Sensitizer | 80 | 90 | 100 | 120 | 50 |
| Dibenzyl terephthalate | 24.9 | 24.1 | 22.5 | 22.1 | 22.0 |
| Higher fatty acid amide | 27.0 | 25.2 | 23.4 | 23.2 | 23.2 |

What we claim is:

1. A heat-sensitive, color developable recording material which carries, on a substrate, a heat-sensitive layer of a composition which comprises a color-developing dye being normally colorless or pale in color, an organic acidic substance capable of causing said color-developing dye to form a color on heating, and a sensitizer selected from the group consisting of dibenzyl terephthalate and dibenzyl isophthalate.

2. A heat-sensitive, color developable recording material according to claim 1 wherein said substrate is a paper.

3. A heat-sensitive, color developable recording material according to claim 1 wherein the sensitizer is dibenzyl terephthalate.

4. A heat-sensitive, color developable recording material according to claim 3 wherein said substrate is a paper.

5. A heat-sensitive, color developable recording material according to claim 1 wherein the sensitizer is dibenzyl isophthalate.

6. A heat-sensitive, color developable recording material according to claim 5 wherein said substrate is a paper.

7. A heat sensitive, color developable recording material according to claim 1 wherein the color-developing dye is a Leuko dye of fluoran type, phthalide type, lactam type, triphenylmethane type or spiropyrane type.

8. A heat-sensitive, color developable recording material according to claim 7 wherein said substrate is a paper.

9. A heat-sensitive, color developable recording material according to claim 1 wherein the organic acidic substance is bis(p-hydroxyphenyl)dimethylmethane.

10. A heat-sensitive, color developable recording material according to claim 9 wherein said substrate is a paper.

11. A heat-sensitive, color developable recording material according to claim 1 wherein the organic acidic substance is benzyl p-hydroxybenzoate.

12. A heat-sensitive, color developable recording material according to claim 11 wherein said substrate is a paper.

13. A heat-sensitive, color developable recording material according to claim 1 wherein the color-developing dye is of the fluoran type and capable of forming a black color.

14. A heat-sensitive, color developable recording material according to claim 13 wherein said substrate is a paper.

15. A heat-sensitive, color developable recording material according to claim 1 wherein the color-developing dye is 3-N-methylcyclohexylamino-6-methyl-7-anilinofluoran, 3-diethylamino-6-methyl-7-anilinofluoran or 3-pyrrolidino-6-methyl-7-anilinofluoran.

16. A heat-sensitive, color developable recording material according to claim 15 wherein said substrate is a paper.

* * * * *